United States Patent [19]

Dahlgren

[11] Patent Number: 4,512,576

[45] Date of Patent: Apr. 23, 1985

[54] STRUNG RACKET AND TENSION ADJUSTING DEVICE THEREFOR

[76] Inventor: Lars Dahlgren, 11A Klockargatan, S-723 44 Västerås, Sweden

[21] Appl. No.: 531,035

[22] Filed: Sep. 12, 1983

[51] Int. Cl.[3] ..... A63B 51/12

[52] U.S. Cl. ..... 273/73 R

[58] Field of Search ..... 273/73 A, 73 B, 73 R, 273/67 R, 73 C, 73 D, 73 E, 73 G, 73 H; 411/542, 544, 338, 339; 24/105, 617, 621

[56] References Cited

U.S. PATENT DOCUMENTS

| | | | |
|---|---|---|---|
| 562,060 | 6/1896 | Young | 411/338 |
| 2,118,561 | 5/1938 | Kleeberg | 411/338 |
| 2,246,109 | 6/1941 | Serrano | 273/73 A |
| 2,723,585 | 11/1955 | Prall | 411/338 |
| 4,070,021 | 1/1978 | Cecka et al. | 273/73 F |
| 4,179,121 | 12/1979 | Kelmanski | 273/73 R |
| 4,180,265 | 12/1979 | Staufer | 273/73 D |

FOREIGN PATENT DOCUMENTS

| | | | |
|---|---|---|---|
| 2724652 | 12/1978 | Fed. Rep. of Germany | 273/73 R |
| 2506938 | 12/1982 | France | 273/73 E |

*Primary Examiner*—Richard C. Pinkham
*Assistant Examiner*—Matthew L. Schneider
*Attorney, Agent, or Firm*—Wood, Dalton, Phillips, Mason, & Rowe

[57] ABSTRACT

A tension adjusting device for a racket consists of two engageable parts. A first part is oblong and U-shaped in cross-section and is attached to one side of the strung surface of the racket. The second part has a cross-sectional width that is smaller than the distance between the legs formed by the U-shaped first part. The second part is fitted between the legs of the first part and held in place through the use of a screw.

10 Claims, 7 Drawing Figures

STRUNG RACKET AND TENSION ADJUSTING DEVICE THEREFOR

This invention relates to a device for adjusting the strings of rackets for ball games, for example tennis, badminton, squash and the like.

The strings in a racket are imparted at the manufacture a certain predetermined tension, depending on the type of the racket and its use. Irrespective of whether the strings are made of nylon or sinews, the tension gradually decreases, owing to fatigue by repeated impacts of the ball during the game and by ageing.

The decrease in tension of the strings has a direct effect on the properties of the racket, and thereby on the sense of playing and its precision. A decrease in the tension of the strings probably is felt more in a tennis racket than in a badminton racket, which is intended for playing with light feather-balls and therefore exposed to less strong forces.

As an example an ordinary tennis racket can be mentioned, which is regarded normally to have strings with a tension of 120–190 N. Depending on the intensity of playing and on age, however, this tension will decrease. Therefore, for further use of the racket, the strings must be tensioned again to about the original value. Heretofore this was possible to be carried out only by a professional in this field who has access to a suitable equipment. Proposals, however, have been made to build-in devices in the racket, by means of which the player or owner him- or herself is able to re-tension the strings.

At a device, for example, disclosed in FR-PS No. 547 639 a certain number of strings are attached on a tensioning device, which by means of a rod extending through the handle of the racket can be screwn in to the handle. This device is relatively heavy and expensive and requires a racket of special design. At another proposal for tensioning the strings of a racket, a round bar is provided on each side of the stringed surface so as to extend across a certain number of strings. Said round bars are offset relative to each other and, according to GB-PS No. 289 297, shall be pressed by means of a central S-shaped plate against the strings. This imagined device is not capable to master the great forces here involved and should not have been used in practice.

The present invention, as it is defined in the characterizing clauses of the attached claims, renders it possible for everybody by simple means to bring about a uniform tension in 6–8 central strings in the racket, which tension then fades uniformly outside the sector of 6–8 strings covered by the tensioning device, at the same times as an advantageous vibration damping is obtained which cuts off the greater oscillation tops at, for example, tennis games. This oscillation damping effect reduces the risk of injury usually involved with playing tennis and known as so-called "tennis arm".

Figure 1:
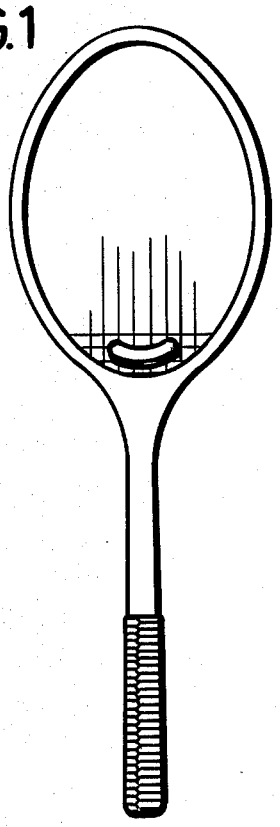
Figure 2:
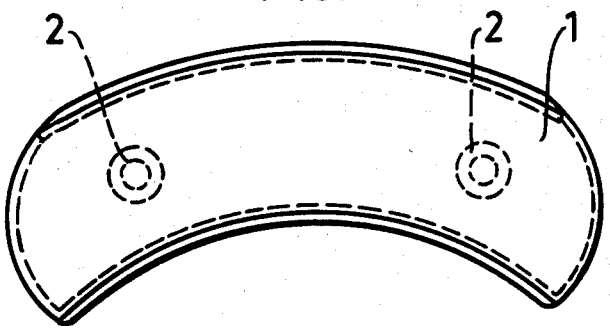
Figure 3:
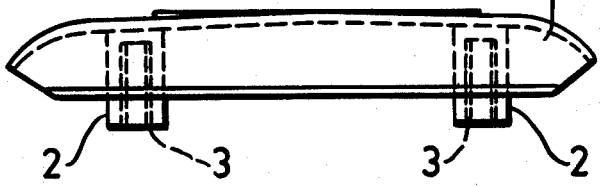
Figure 4:
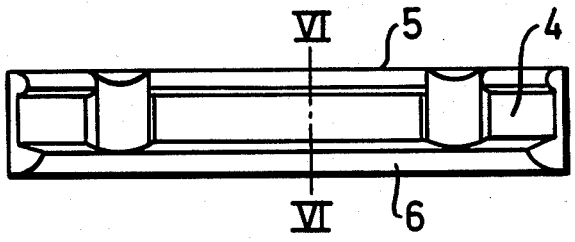
Figure 6:
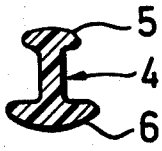
Figure 5:
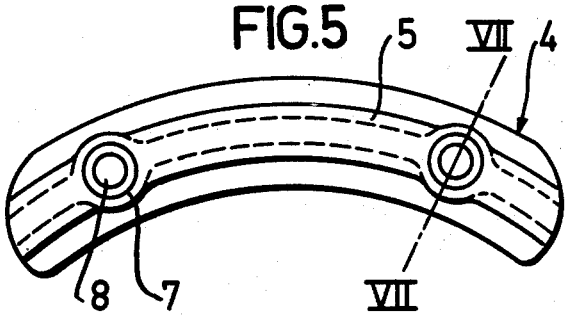
Figure 7:
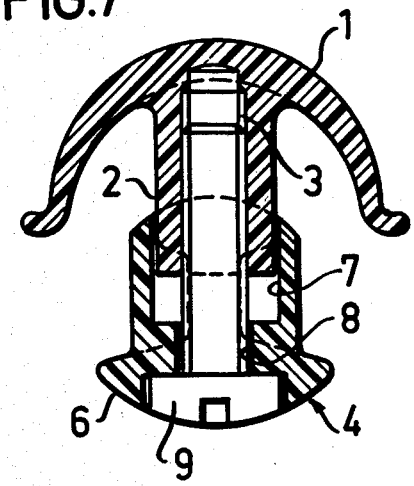

The invention is described in greater detail in the following by way of an embodiment and with reference to the accompanying drawing, in which FIG. 1 shows a tennis racket with mounted adjusting device according to the invention, FIG. 2 is a view from above of the first part of the device, FIG. 3 is a lateral view of said first part, FIG. 4 is a lateral view of the second part of the device, FIG. 5 is a view from above of said second part, FIG. 6 is a section of said second part along the line VI—VI, and FIG. 7 is an enlarged section through the two parts mounted to each other along the line VII—VII.

The adjusting device according to the invention comprises a first part 1 (FIGS. 2, 3, 7), which seen from above extends arc-shaped and in principle has U-shaped section, see FIG. 7. The legs or edges of part 1 are rounded-off and bent outward, as appears from FIG. 7. The part 1 further comprises two cylinder-shaped projections 2, in which threaded bores 3 are located.

The device according to the invention further consists of a second part 4 (FIGS. 4, 5, 7), which in principle has I-shaped section, see also FIG. 6. The upper edge of "flange" 5 has a width, which is substantially smaller than the inner width of the section of the first part between the outward bent edges. The second edge or "flange" 6 of the second part 4 is substantially wider than the firstmentioned flange 5. In two places corresponding to the location of the projections 2 of the first part 1, the web of the second part 4 is thickened and includes a first bore 7 with a diameter slightly exceeding the diameter of the projections 2, and a second through bore 8. The part 4, thus, can be attached from below in the first part 1, with the bores 7 enclosing the projections 2. The parts are held together by two screws 9, the heads of which are sunk in the edge 6 of the part 4, as is clearly shown in FIG. 7. By screwing the screws 9 into or out of the threaded bores 3, the upper edge 5 of the part 4 can be moved more or less from a plane through the two folded edges of the part 1.

The adjusting device according to the invention is applied directly on the strings of the racket blade adjacent the transition of the racket frame into the handle and slightly, about 3 cm, spaced from the frame edge, as shown in FIG. 1. The first part 1, thus, is attached on one side of the strings, and the second part 4 on the other side, and the parts are forced against each other by the screws 9. The adjusting device according to the invention may, for example, have such a length that it extends across 6–8 strings, as is shown in FIG. 1.

When it is deemed suitable to tension the strings of the racket, the device according to the invention is applied in the way described above. This is facilitated in that the cylindric projections 2 extend outside a plane through the folded edges of the first part 1 through a distance, which is greater than the thickness of the strings, whereby the second part 4 by means of its bores 7 can be guided directly into correct position in relation to the first part 1.

By means of the screws 9, which move the parts 1 and 4 against each other, the 6–8 strings, which on one side are affected by the folded edges of the part 1 and on the other side by the rounded flange 5 of the part 4, are bent is response to the degree in which the part 4 is screwed against the part 1. It should be easily understood that the 6–8 strings will be tensioned, and that this tension propagates to all longitudinal strings. This increase in tension, stretching, of the longitudinal strings, together with the relative flexibility of the racket frame, implies automatically that also the transverse strings plaited in the longitudinal strings will be stretched.

The present invention as described above renders it possible by some simple manipulations to tension a plurality of central strings, so that the tension is distributed fadingly over the entire racket surface. The adjusting device, which after its first use remains stationary on the racket, has in addition to the possibility of tensioning the strings also a vibration damping effect on the racket during the game. These oscillations, which otherwise assume relatively high amplitudes, propagate through the racket to the player's arm and influence his or hers physical condition.

The device according to the invention preferably is made of a very strong and very light material, for example carbon fibre reinforced plastic (PPS plastic). The weight should clearly be below 15 g (perceptible limit for an ordinary player) and preferably be 8 to 10 g. The device, of course, should be located outside the playing surface and as close as possible to the balance point of the racket. Tests, however, carried out so far have proved that, for obtaining sufficient tension values, it is necessary to position the adjusting device according to the invention about 2–3 cm from the frame edge.

What I claim is:

1. The combination of a racket and a device for attachment to and to remain attached to said racket during play, said racket comprising a frame with interwoven longitudinal and transverse strings strung thereacross to form a planar playing surface;

said device providing a means for adjusting the tension of said strings and comprising: a first elongated part being generally U-shaped in a transverse cross-section and providing spaced apart edges for contact with said strings, the area between said spaced apart edges defining an open mouth; said device further comprising a second part having a length substantially equal to the length of said first part and a width less than the distance between the edges of said first part and means for securing said first and second parts together on opposite sides of said planar playing surface and in contact with said strings;

said securing means providing a varying degree of penetration by said second part into the open mouth of said U-shaped first part so as to adjust the tension of the strings of the racket.

2. The combination of a racket and a device according to claim 1 in which said first and second parts have a length sufficient to span a plurality of the longitudinally extending strings of a racket and in which said securing means includes two spaced apart projections adapted to pass through the mesh formed by the interwoven strings.

3. The combination of a racket and a device according to claim 2 in which said first and second parts are curvilinear.

4. The combination of a racket and a device accoring to claim 1 in which said first and second parts have a length sufficient to span at least six of the longitudinally extending strings of a racket and in which said securing means includes two spaced apart projections adapted to pass through the mesh formed by the interwoven strings.

5. The combination of a racket and a device according to claim 1 in which said securing means comprises an internally threaded boss projecting outwardly from said first part beyond the edges thereof, said second part has a bore therethrough registering with said boss when placed in position for assembly with said first part and a screw extending through the bore in said second part and threaded into said boss of said first part.

6. The combination of a racket and a device according to claim 1 in which said securing means comprises two projections extending outwardly from said first part beyond the edges thereof; each projection having an outwardly opening, internally threaded bore; and two receiving means extending from said second part, each adapted to telescopically receive one of said projections and each formed with a stepped bore threrethrough for the reception of a screw extending through said stepped bore and into the threaded bore of said projection.

7. The combination of a racket and a device according to claim 1 in which the edges of said first part are rounded and said second part has a rounded surface where it contacts the strings.

8. The combination of a racket and a device according to claim 1 in which the device is made of carbon fiber reinforced plastic.

9. The combination of a racket and a device according to claim 1 in which the device has a weight in the range of eight to ten grams.

10. The combination of a racket and a device according to claim 1 in which the device has a weight which is less than 15 grams.

* * * * *